US006976332B2

(12) United States Patent
Clarke

(10) Patent No.: US 6,976,332 B2
(45) Date of Patent: Dec. 20, 2005

(54) COMBINATION PICTURE RETAINING AND ITEM STORING DEVICE

(76) Inventor: Ronald D. Clarke, 959 Lee, Algonac, MI (US) 48001

( * ) Notice: Subject to any disclaimer, the term of this patent is extended or adjusted under 35 U.S.C. 154(b) by 126 days.

(21) Appl. No.: 10/361,312

(22) Filed: Feb. 10, 2003

(65) Prior Publication Data

US 2003/0150150 A1 Aug. 14, 2003

Related U.S. Application Data

(60) Provisional application No. 60/356,565, filed on Feb. 11, 2002.

(51) Int. Cl.[7] ..... A47G 1/06

(52) U.S. Cl. ..... 40/725; 40/765; 40/721; 40/722

(58) Field of Search ..... 40/765, 721, 722, 40/724, 720, 734, 735, 771, 790, 791, 725

(56) References Cited

U.S. PATENT DOCUMENTS 481,117 A * 8/1892 Naegele ..... 40/790
539,318 A * 5/1895 Wanner ..... 70/790
1,608,651 A * 11/1926 Farmer ..... 40/642.02
1,904,318 A * 4/1933 Lehere ..... 40/791
2,177,187 A * 10/1939 Olsen ..... 40/658
6,112,445 A * 9/2000 Feeney ..... 40/747
6,371,296 B1 * 4/2002 Rumbough ..... 206/494
6,393,749 B1 5/2002 Haupt
6,508,021 B2 * 1/2003 Ong ..... 40/312

* cited by examiner

*Primary Examiner*—Mark T. Le

(57) ABSTRACT

A combination picture retaining and item storing device that has an integrally formed plastic structure. The structure includes at least two sidewalls that extend from a base. At least one of the sidewalls has a hole formed through the sidewall. A storage area is disposed adjacent and integrally formed with the at least two sidewalls. A separate picture retaining member having a translucent planar body including first and second parallel portions are joined at a radius. The first and second parallel portions allow for retention of a picture in a gap formed by the opposing portions. Retaining features formed on an inner surface and around a periphery of the hole positions the picture retaining member within the periphery of the hole and allows for easy removal of the picture retaining member.

4 Claims, 3 Drawing Sheets

COMBINATION PICTURE RETAINING AND ITEM STORING DEVICE

This claims the benefit of Provisional Application No. 60/356,565, filed Feb. 11, 2002.

FIELD OF THE INVENTION

The invention relates to a combination picture retaining and item storing device, and with more particularity to a combination picture retaining and item storing device having a removable picture retaining member.

BACKGROUND OF THE INVENTION

Picture retaining and item storing devices are known in the art. Generally such picture retaining and storage devices are formed of an assembly of parts that are put together to form the overall structure of such a device. There is, therefore, a need in the art for an integrally formed plastic structure that may be utilized as a picture retaining and item storing device. Such a plastic structure has the advantage of providing for numerous aesthetic features such as different colors, as well as lettering or other designs incorporated into the structure of the picture retaining and storing device. Such a device should be easy to manufacture and allow for numerous configurations to accommodate a number of primary functions.

There is also a need for a combination picture retaining and item storing device that includes a separate picture retaining member that may be easily attached and removed from the overall structure of the picture retaining and storing device. Such a device would allow for easy replacement of a picture by simply snapping a picture retaining member within retaining features integrally formed on the structure of the device. There is, therefore, a need in the art for a combination picture retaining and item storing device that is an integrally formed plastic structure that is aesthetically pleasing to the eye, as well as allows for the quick and simple replacement of pictures contained within the picture retaining portion of such a device.

SUMMARY OF THE INVENTION

A combination picture retaining and item storing device that includes an integrally formed plastic structure. The structure includes at least two sidewalls that extend from a base. At least one of the sidewalls has a hole formed therein. A storage area is disposed adjacent and integrally formed with the at least two sidewalls. A separate picture retaining member that has a translucent planar body having first and second parallel portions are joined at a radius. The first and second portions define a gap that retains a picture. A plurality of retaining features are formed on an inner surface of the sidewall and around a periphery of the hole formed in at least one of the sidewalls. The picture retaining member is positioned within the periphery of the hole and is releasably retained in position by the plurality of retaining features.

Other objects and advantages of the invention will be understood from a description of preferred embodiments. Reference will be made to drawing figures that are described in the following section.

DETAILED DESCRIPTION OF THE PREFERRED EMBODIMENTS

The practice of the invention will be illustrated by describing various embodiments of a combination picture retaining and item storing device having an integrally formed plastic structure preferably made by injection molding.

Figure 1:
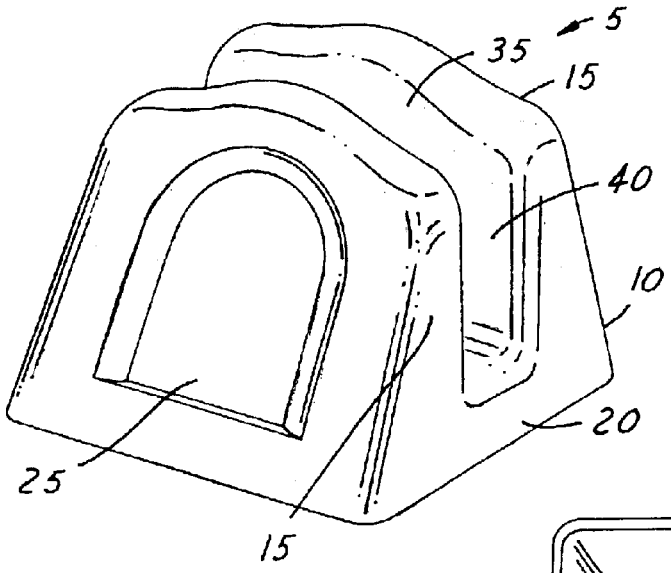
FIG. 1 is a perspective view of a first embodiment of the combination picture holding and item storing device detailing the outer surface and hole formed in one of the sidewalls.

With reference to FIG. 1, there is shown a first embodiment of the combination picture retaining and item storing device 5 of the present invention. As can be seen, the picture retaining and item storing device 5 includes an integrally formed plastic structure 10 having at least two sidewalls 15 extending from a base 20. In the pictured embodiment, two sidewalls 15 extend upward from the base 20 at an angle that is the mirror image of the opposing sidewall 15. One of the sidewalls 15 includes a hole 25 formed therein. The hole 25 is to receive a picture retaining member 30 as shown in FIG. 2, and will be discussed in more detail below.

A storage area 35 is disposed adjacent and integrally formed with the two opposing sidewalls 15. In the pictured embodiment shown in FIG. 1, the storage area 35 comprises a central trough 40 disposed between and integrally formed with the two oppositely positioned sidewalls 15. The central trough 40 may be utilized to receive and store items such as papers or napkins or other similar materials.

Figure 2:
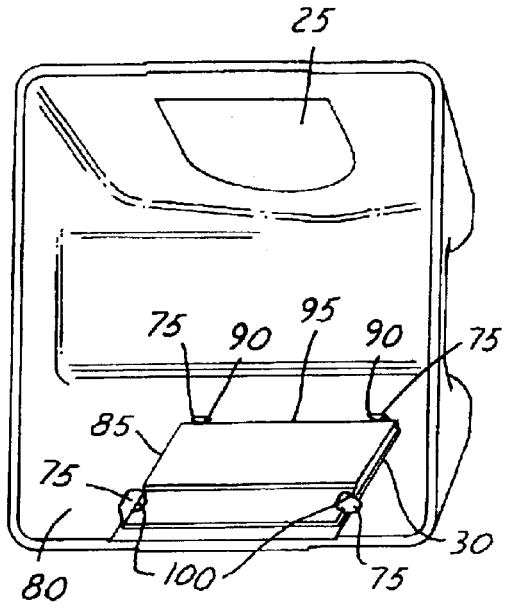
FIG. 2 is a bottom view of the picture holding and item storing device shown in FIG. 1.
Figure 3:
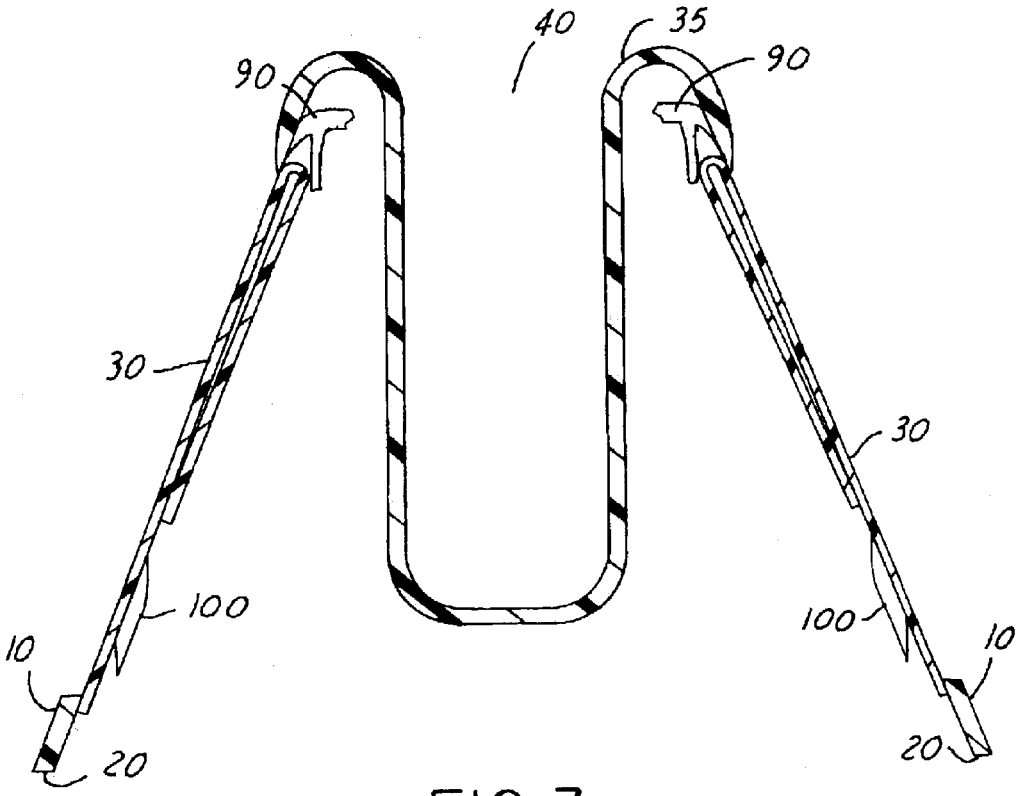
FIG. 3 is a sectional view detailing the picture retaining member being retained by a plurality of retaining features of the picture holding and item storing device.
Figure 5:
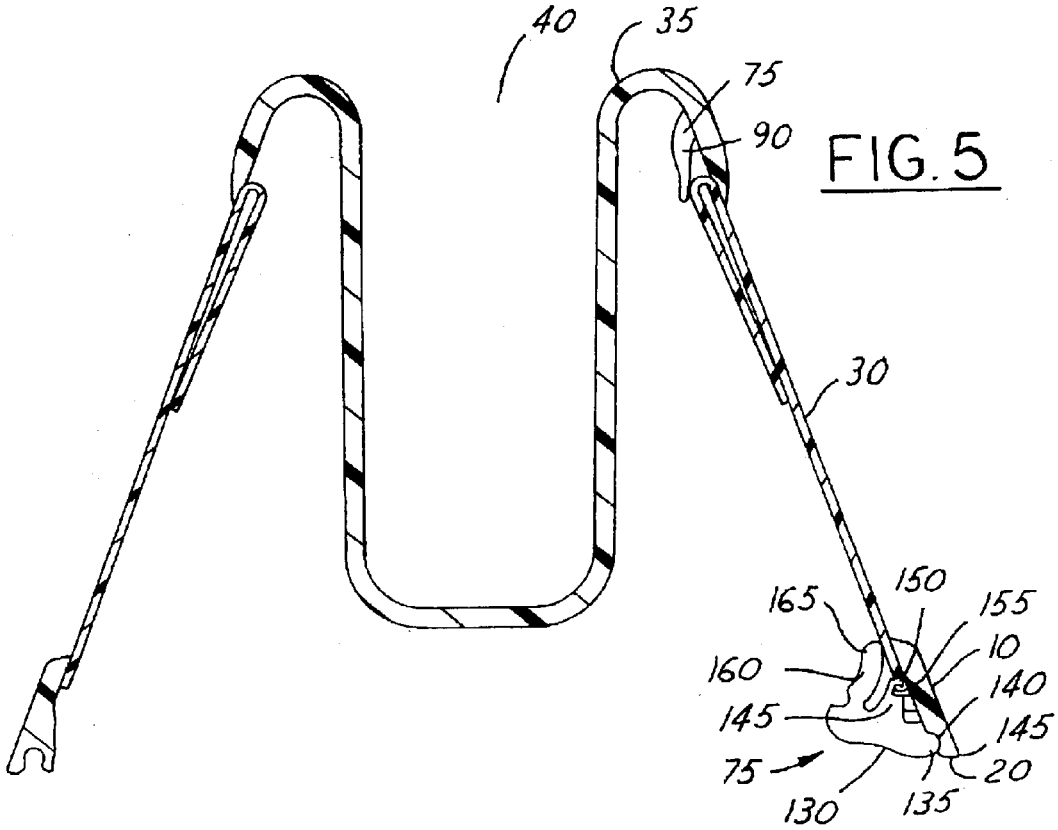
FIG. 5 is a sectional view of an alternative embodiment of a retaining feature for use by the present invention.

A picture retaining member 45, as best seen in FIGS. 2, 3 and 5, generally comprises a translucent planar body 30 preferably made of plastic and having first 55 and second 60 parallel portions joined at a radius 65. The first and second portions 55, 60 define a gap 70 for retaining a picture. As can be seen in FIGS. 2, 3 and 5, the picture retaining member 45 is a separate component that may be attached and removed from a plurality of retaining features 75 formed on an inner surface 80 and around the periphery 85 of the hole 25 formed in at least one of the sidewalls 15. In a preferred aspect of the present invention, the picture retaining member 45 is positioned within the periphery 85 of the hole 25 and releasably retained by the plurality of retaining features 75.

Figure 4:
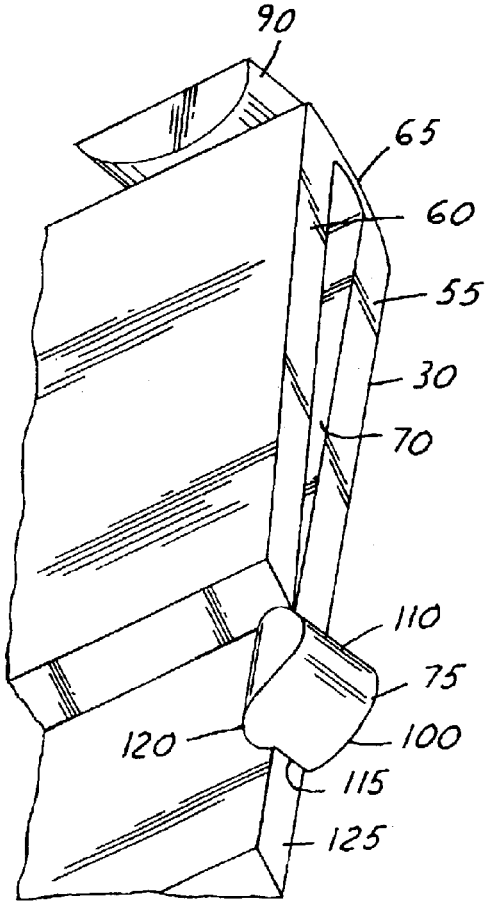
FIG. 4 is an enlarged perspective view of the picture holding member being retained by a retaining feature.

As stated above, the plurality of retaining features 75 formed on the inner surface 80 are positioned around a periphery 85 of the hole 25 formed in at least one of the sidewalls 15. In a first aspect of the invention, and as shown in FIG. 3, the plurality of retaining features 75 generally comprises two integrally formed and oppositely positioned fixed planar extensions 40 associated with a top portion 95 of the periphery of the hole 85. The fixed planar extensions 90 mate with the picture retaining member 45 to locate the picture retaining member 45, rather than grippingly engage the picture retaining member 45 as will be described below with reference to other of the plurality of retaining features 75. Again with reference to FIGS. 2 and 3, the plurality of retaining features 75 further comprises two integrally formed and obsolete positioned snap retainers 100 associated with a bottom portion 105 of the hole 25. As best seen in FIG. 4, the snap retainers 100 comprise a raised protrusion 110 capable of flexing to engage and disengage the picture retaining member 45. Each protrusion 110 comprises a planar extension 115 terminating in a bulbous region 120 that snaps over an edge 125 of the picture retaining member 45 when positioned within a periphery 85 of the hole 25.

In an alternative embodiment of the present invention shown in FIG. 5, the plurality of retaining features 75, again includes two integrally formed and oppositely positioned fixed planar extensions 90 associated with a top portion 95 of the periphery 85 of the hole 25. However, as opposed to the previously described embodiment, the snap retainer 100 comprises a centrally located snap retainer 130 positioned along a bottom edge 135 of the hole 25. In a preferred aspect, the snap retainer 130 comprises a rounded bottom portion 135 that is adapted to be fit into a retention groove 140 formed in a bottom 145 of the base 20. A central portion 145 including a hook portion 150 adapted to be snapped within a notch 135 formed on an inner surface 80 of the sidewall 15 that has the hole 25 formed therein. The snap retainer 130 further includes an upper portion 160 having a flexible finger 165 that engages the picture retaining member 45. In use, the picture retaining portion 45 is positioned by the fixed planar extensions 90 previously described and the snap retainer 130 is pivoted about the rounded bottom portion 135 until it is in contact with the picture retaining member 45. In this position the hook portion 150 can be snapped into the notch 155. The flexible finger 165 of the upper portion 160 applies a constant pressure to the picture retaining member 45 holding it in position within the periphery 85 of the hole 25. Whether the first embodiment of the plurality of fasteners 75 or the second embodiment of the plurality of fasteners 75 is utilized by the present invention, the picture retaining member 45 may be easily attached and removed from the plastic structure 10 thereby enabling a person to quickly exchange pictures. Although not shown in the first embodiment, as shown in FIGS. 1–5, an outer surface 165 of the sidewall 15 may further include decorative patterns or lettering to improve the overall aesthetic appearance of the combination picture retaining and item storing device 5. Again, as referenced above, numerous colors may be incorporated into the integrally formed plastic structure 10.

Figure 6:
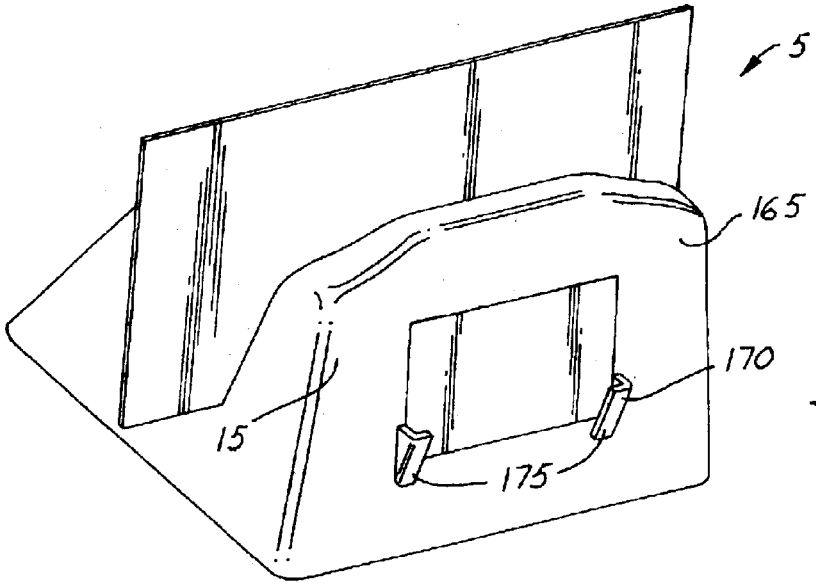
FIG. 6 is a perspective view of a second embodiment of a combination picture retaining and item storing device detailing raised storage features on an outer surface of one of the sidewalls.

With reference to FIG. 6, there is shown a second embodiment of the combination picture retaining and item storing device 5 similar in regards to that disclosed in FIG. 1 with the addition of raised storage features 170 formed on an outer surface 165 of the sidewall 15 without a hole 25 formed therein. In a preferred aspect, the raised storage features 170 comprise a pair of brackets 175 spaced from each other and attached to the outer surface 165 of the sidewall 15 for retaining a business card. The plurality of retaining features 75 may be as disclosed in either the first or second embodiment of the retaining features 75.

Figure 7:
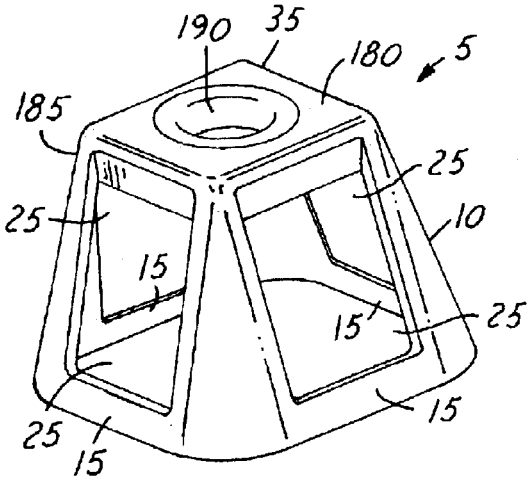
FIG. 7 is a perspective view of a third embodiment of the combination picture retaining and item storing device for use as a picture retaining and candle holding device.

FIG. 7 displays a third embodiment of the combination picture retaining and item storing device 5 of the present invention. In this embodiment, the picture retaining and item storing device 5 includes a plastic structure 10 comprising four sidewalls 15 joined to form a pyramid structure. In a preferred aspect, each of the four sidewalls 15 has a hole 25 formed therein to receive a picture retaining member 45. As with the previously described embodiments, each of the four sidewalls 15 includes a plurality of retaining features 75 formed on an inner surface 80 and around a periphery 85 of the holes 25. Either of the embodiments of the retaining features 75 may be utilized by the pyramid structure, as above described.

The storage area 35 of the third embodiment comprises a flattened, planar surface 180 formed at a top portion 185 of the pyramid structure. With reference to FIG. 7, the flattened, planar surface 180 may further include a depression 190 formed therein for receiving an item such as a candle.

Figure 9:
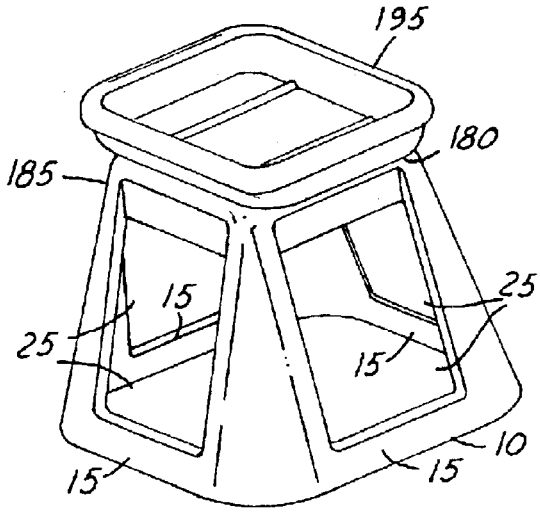
FIG. 9 is a perspective view of the third embodiment disclosed in FIG. 7 used as a soap retaining device.
Figure 8:
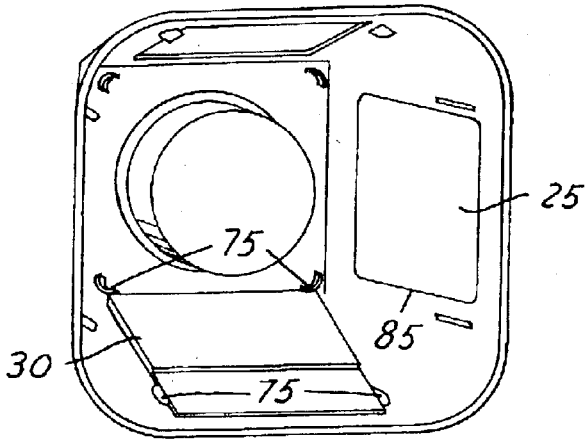
FIG. 8 is a bottom view of the third embodiment depicted in FIG. 7 detailing attachment of a picture retaining member within the plastic structure.

With reference to FIG. 9, an alternative design of the third embodiment may further include a soap dish 195 that is positioned atop the flattened planar surface 180. Other items including an ashtray, potpourri dish or other similar item may be placed atop the flattened planar surface 180 of the third embodiment.

While the invention has been described in terms of certain preferred embodiments, it is apparent that other embodiments could readily be devised by one skilled in the art. The scope of the invention is to be considered limited only by the following claims.

What is claimed is:

1. A combination picture retaining and item storing device comprising:

an integrally formed plastic structure consisting of a base and two sidewalls extending from said base, the sidewalls including inner an outer surfaces, one of the two sidewalls having a hole formed therein;

a storage area disposed adjacent and integrally formed with the two sidewalls wherein the storage area comprises a central trough disposed between and integrally formed with the two oppositely positioned sidewalls, and said trough includes an open top and open ends;

a picture retaining member comprising a translucent planar body having first and second parallel portions joined at a radius, the first and second portions defining a gap for retaining a picture;

a plurality of retaining features formed on an inner surface and around a periphery of the hole formed in at least one of the sidewalls;

the picture retaining member positioned within the periphery of the hole and releasably retained in position by the plurality of retaining features.

2. The combination picture retaining and item storing device of claim 1 wherein the plurality of retaining features further includes two integrally formed and oppositely positioned snap retainers associated with a bottom portion of the hole.

3. The combination picture retaining and item storing device of claim 2 wherein the snap retainers comprise a raised protrusion capable of flexing to engage and disengage the picture retaining member, and wherein the protrusion comprises a planar extension terminating in a bulbous region that snaps over an edge of the picture retaining member.

4. A combination picture retaining and item storing device comprising:

an integrally formed plastic structure having two sidewalls extending from a base, the sidewalls including inner and outer surfaces, one of the two sidewalls having a hole formed therein;

a storage area disposed adjacent and integrally formed with the at least two sidewalls wherein the storage area comprises a central trough disposed between and integrally formed with the two oppositely positioned sidewalls;

a picture retaining member comprising a translucent planar body having first and second parallel portions joined at a radius, the first and second portions defining a gap for retaining a picture;

a plurality of retaining features formed on an inner surface and around a periphery of the hole formed in at least one of the sidewalls;

the picture retaining member positioned within the periphery of the hole and releasably retained in position by the plurality of retaining features wherein the plurality of retaining features comprises two integrally formed and oppositely positioned fixed planar extensions associated with a top portion of the periphery of the hole and further includes a centrally located snap retainer positioned along a bottom edge of the hole;

wherein the centrally located snap retainer comprises a rounded bottom portion adapted to be fit into a retention groove formed in a bottom of the base, a central portion including a hook portion adapted to be snapped within a notch formed on an inner surface of the sidewall, and an upper portion having a flexible finger and wherein the snap retainer pivots within the retention groove about the rounded bottom portion whereby the centrally located snap retainer is pivoted into contact with the picture retaining member such that the hook portion snaps into the notch and wherein the flexible finger applies a pressure to the picture retaining member holding it in position within the periphery of the hole.

* * * * *